US009080322B1

(12) United States Patent
Rodrigues

(10) Patent No.: US 9,080,322 B1
(45) Date of Patent: Jul. 14, 2015

(54) LAVATORY SINK COVER FOR HAIR GROOMING

(71) Applicant: Leonardo G. Rodrigues, Gainesville, FL (US)

(72) Inventor: Leonardo G. Rodrigues, Gainesville, FL (US)

( * ) Notice: Subject to any disclaimer, the term of this patent is extended or adjusted under 35 U.S.C. 154(b) by 249 days.

(21) Appl. No.: 13/913,703

(22) Filed: Jun. 10, 2013

(51) Int. Cl.
*E03C 1/244* (2006.01)
*E03C 1/186* (2006.01)

(52) U.S. Cl.
CPC ..... *E03C 1/186* (2013.01)

(58) Field of Classification Search
CPC ..... E03C 1/186; A47K 1/06
USPC ..... 4/654–657, 531
See application file for complete search history.

(56) References Cited

U.S. PATENT DOCUMENTS

| | | | | |
|---|---|---|---|---|
| 2,817,851 | A * | 12/1957 | Barnwell | 4/655 |
| 5,991,942 | A * | 11/1999 | Neal | 4/655 |
| 6,959,461 | B1 * | 11/2005 | Sanchez | 4/654 |
| 7,685,654 | B1 * | 3/2010 | Jones | 4/655 |
| 2007/0180610 | A1 * | 8/2007 | Mohr et al. | 4/655 |
| 2010/0325791 | A1 * | 12/2010 | Davidowitz | 4/655 |

* cited by examiner

*Primary Examiner* — Huyen Le
(74) *Attorney, Agent, or Firm* — Sven W. Hanson

(57) ABSTRACT

A sink cover is provided with a domed portion to accommodate conventional sink fixtures and allow the cover to lay in a generally planar attitude in use. The perimeter of the cover includes folded portions to capture and retain loose hair that falls onto the cover during use. The cover is preferably formed of thin water-resistant paper to enable compact packaging.

5 Claims, 3 Drawing Sheets

LAVATORY SINK COVER FOR HAIR GROOMING

BACKGROUND

The invention pertains to articles used to protect personal lavatory sinks from falling hair resulting from personal grooming.

SUMMARY

The invention provides a cover configured to be placed over, and protect, a lavatory or counter sink or the like from falling hair during personal grooming activities by the user. The inventive cover includes a thin water-resistant paper cover sized and shaped to cover a conventional sink or lavatory. The perimeter of the cover includes a folded portion configured to capture and retain any loose material falling onto the upper surface of the cover. A upwardly domed portion of the cover is configured and located on the cover to fit over existing lavatory fixtures extending above the nominal surface of the user's sink or lavatory, while the remaining portion of the inventive cover projects over the sink or lavatory bowl and immediately surrounding space. The domed portion is located off-center to accommodate the typical relative placement of lavatory fixtures. A bowled portion of the cover may be included.

Optionally, the inventive cover may include adhesive attachments configured to attach at least a portion of the cover perimeter to the surrounding surface during use.

Details of particular embodiments of the invention are provided in the following discussion and associated drawing figures. The scope of the invention is intended to be defined by the accompanying claims.

DETAILS OF EMBODIMENTS OF THE INVENTION

Figure 1:
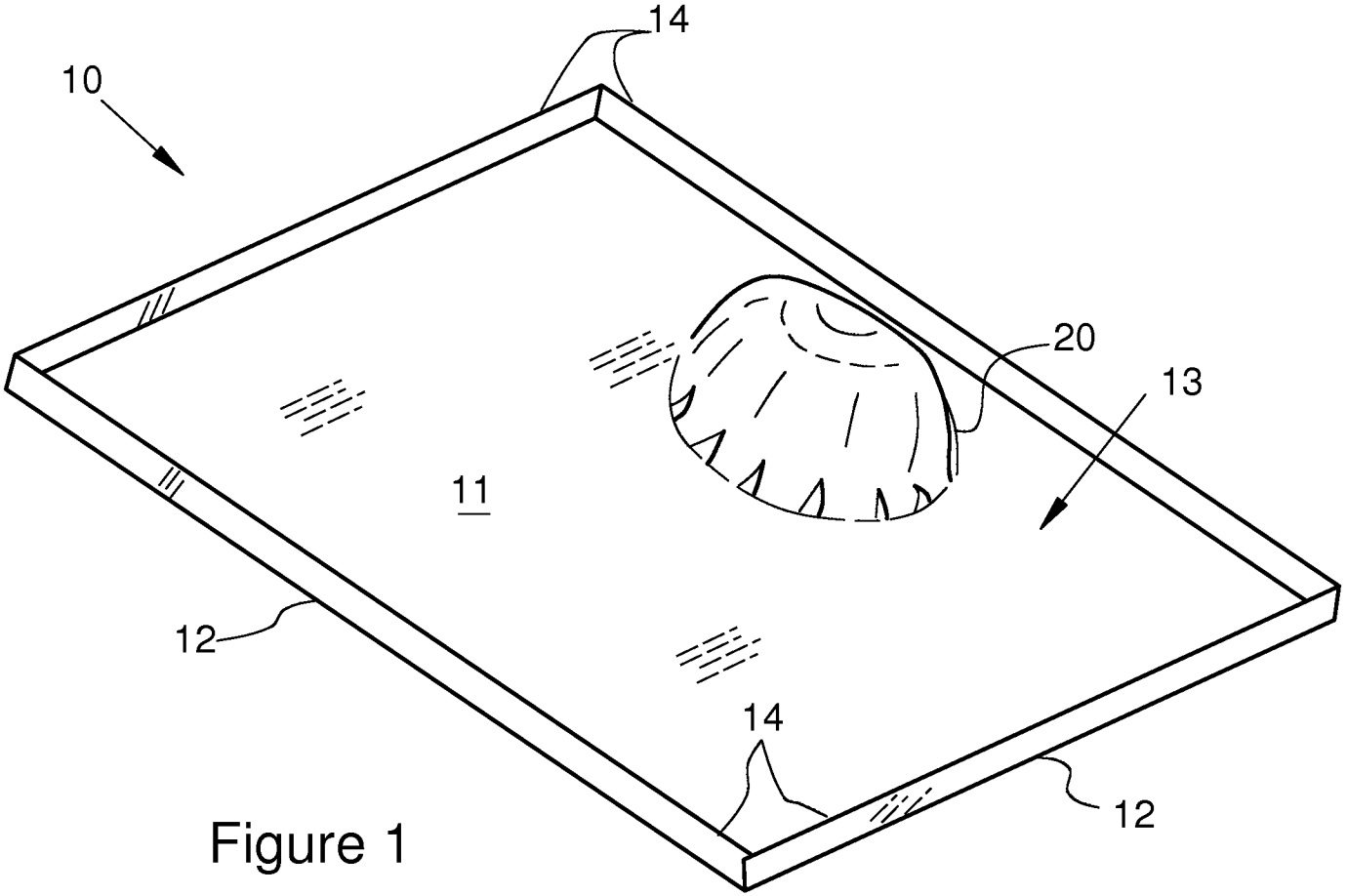
FIG. 1 is a perspective view of the inventive cover.
Figure 2:
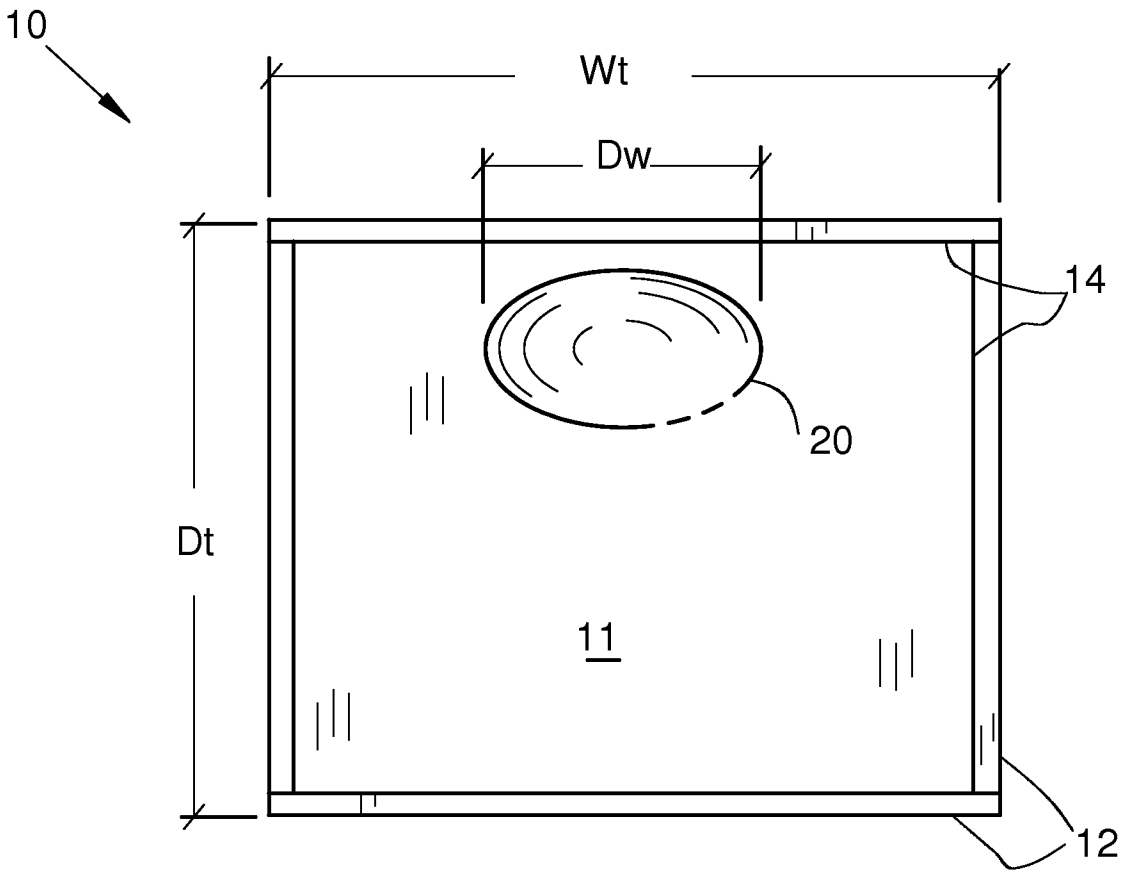
FIG. 2 is a top plan view of the inventive cover.

FIGS. 1 and 2 illustrate the same embodiment of the invention and the following discussion relates to both figures. The inventive cover 10 includes a body portion 11 which is generally planar. The cover 10 is preferably formed of thin waxed paper or similar water-resistant sheet material that can be easily folded and compacted for the purposes of improved commercial use and value. Herein, "water-resistant" means a material that does not absorb a substantial amount of water on contact with incidental amounts of water and does not substantially change form or property upon contact with water or similar liquids. Because the cover 10 is intended to be used in locations where there may be incidental water, water-resistant properties are necessary.

The body portion 11 should be sufficiently large to encompass and cover, in a horizontal plane above, most conventional residential sink or lavatory bowls and their associated faucets fixtures that are present on the level of the upper surface of the bowl. For this function, the body portion 11 should have a width dimension WT at least 20 inches and more preferably in the range of 24 to 36 inches. The body portion's depth dimension Dt, perpendicular to the width, should be in the range of 12 to 28 inches.

The perimeter 12 of the cover 10 includes a folded portion 14 that extends inwardly above the upper face of the cover 10. The function of the folded portion 14 is to capture and retain on the cover 12 any loose articles such as hair that fall onto the cover during use. For that purpose, the length of the folded portion 14 outward (unfolded) from the perimeter 12 is preferably in the range of ½ to one inch. The included angle between the folded portion 14 and the remaining body portion 11 is shown to be acute, but may be acute or obtuse and a preferable angle is between 75 and 105 degrees.

Preferably, the body portion 11 is rectangular in overall shape, with associated straight edge perimeter portions, such that the folds may be most easily formed along straight fold lines. However, the body portion 11 may have an overall shape including curved edge portions and still function as desired herein.

A domed portion 20, formed of similar paper material as is the body portion 11, extends upward from the upper surface 13 of the body portion 11. The domed portion 20 may be formed of pleated flat sheet paper that is then fixed to the body portion 11. Alternatively, the domed portion 20 may be formed integral to the body portion 11. In all cases, the domed portion 20 and body portion 11 must be contiguous within the perimeter 12 to ensure complete capture of hair and the like falling on the cover 10 during use.

The dimensions of the domed portion 20 should be large enough to cover most conventional personal sink or lavatory fixtures such as are found in home bathrooms or similar residential spaces. For this purpose, the domed portion should have a width dimension DW (FIG. 2), centered on and parallel to one edge (back edge) portion of the perimeter 12 in the range of 12 to 24 inches and a height dimension DH (FIG. 3), extending perpendicularly above the upper surface 13, in the range of 6 to 16 inches.

Because, conventional sink fixtures are located at the edge of the associated sink bowl, the domed portion 20 must be located off-center and adjacent the perimeter of the body portion 11.

Figure 3:
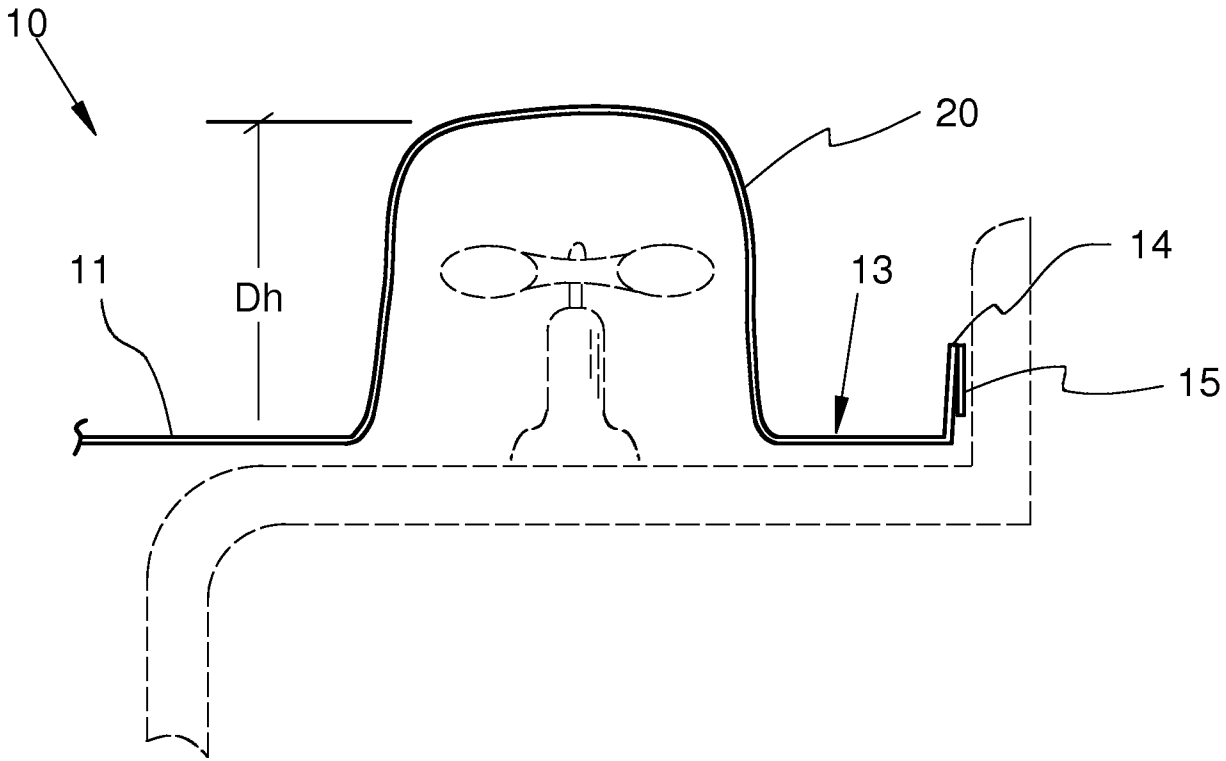
FIG. 3 is a side section view of a portion of an alternative embodiment on the invention.

FIG. 3 depicts an alternative embodiment that includes an adhesive tab 15 located on a surface of the body portion 11 or folded portion 14 surface opposing the upper surface 13 (lower or backside surface). The function of the adhesive tab 15 is to enable the cover 10 to be secured to an adjacent working surface such as the surface of a lavatory counter or backsplash or wall. In FIG. 3, the domed portion 20 is shown in section covering a sink fixture (shown in dashed outline).

An alternative embodiment provides additional benefit for use with sinks that do not have a surrounding countertop that might support the perimeter of the inventive cover. For this use, the alternative embodiment of the cover is sized and shaped such that in use, the cover 10 does not substantially extend past the edges of a sink or lavatory surface, to prevent more than a limited perimeter portions of the cover 10 being unsupported and potentially hanging vertically. Alternatively, the cover 10 paper should be selected or formed with sufficient stiffness to preclude downward draping of the cover 10 past edges of the associated sink or lavatory structure. For this purpose, the cover body portion 11 may be butcher or kraft paper or the like that also has water-resistant properties such as waxing. Preferably, the dome portion 20 is still formed of lighter-weight highly flexible paper, as previously discussed, to enable it to be compacted or crushed into a planar form without tearing, when not in use.

The invention claimed is:

1. A sink cover for a sink bowl and associated fixtures, the cover comprising:

a generally planar body portion having a perimeter;

a folded portion extending contiguously along the entire perimeter;

a domed portion extending upward from body portion;

and comprising flexible sheet paper having water-resistant properties;

such that the domed portion may be placed over sink fixtures while the body portion maintains a substantially planar configuration over a sink adjacent the fixtures.

2. A sink cover, according to claim 1, and wherein:

the domed portions is configured to be crushable to a planar orientation without tearing; and the body portion is formed of material more rigid than the domed portion.

3. A sink cover, according to claim 2, and wherein:

the body portion comprises kraft paper.

4. A sink cover, according to claim 1, and wherein:

the body portion has rectangular shape and sized to overlay a conventional sink, and the domed portion has a height dimension sufficient to cover conventional lavatory faucets.

5. A sink cover, according to claim 4, and wherein:

the height dimension is in the range of 6 to 16 inches.

* * * * *